United States Patent [19]

Zierler et al.

[11] Patent Number: 4,671,182

[45] Date of Patent: Jun. 9, 1987

[54] INERTIA PROJECTILE OR SUB-CALIBER

[75] Inventors: Reinhard Zierler, Micheldorf; Ekkehard Auer, Linz, both of Austria

[73] Assignee: Voest-Alpine Aktiengesellschaft, Linz, Austria

[21] Appl. No.: 785,057

[22] Filed: Oct. 4, 1985

[30] Foreign Application Priority Data

Oct. 24, 1984 [AT] Austria ..... 3388/84

[51] Int. Cl.[4] ..... F42B 13/16

[52] U.S. Cl. ..... 102/521

[58] Field of Search ..... 102/520–524, 102/430

[56] References Cited

U.S. PATENT DOCUMENTS 3,430,572 3/1969 Hebert .
3,882,777 5/1975 Rausing ..... 102/521
4,524,695 6/1985 Bisping ..... 102/430

FOREIGN PATENT DOCUMENTS 2039719 3/1971 Fed. Rep. of Germany .
2945291 5/1981 Fed. Rep. of Germany ..... 102/520
2237169 2/1975 France ..... 102/520

*Primary Examiner*—Harold J. Tudor
*Attorney, Agent, or Firm*—Cushman, Darby & Cushman

[57] ABSTRACT

An inertia projectile includes a penetrator (1) and a caliber-compensating propellent cage (2). The propellent cage has at its rear front front wall (9) perforations (3) opening into a cavity (4). The cavity is otherwise completely closed by a front wall (7) conically extending relative to the penetrator (1) and by a surrounding cylindrical mantle (6).

9 Claims, 1 Drawing Figure

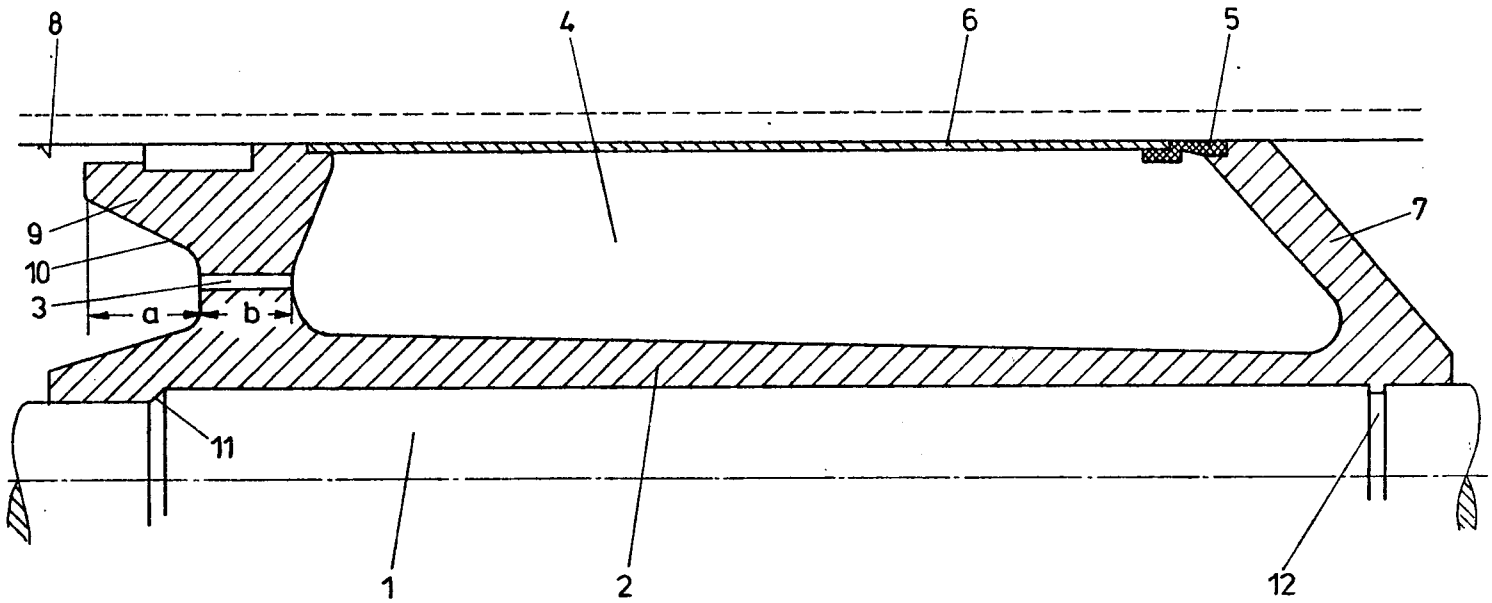
8
9
10
3
a
b
11
4
6
5
7
1
2
12

INERTIA PROJECTILE OR SUB-CALIBER

BACKGROUND OF THE INVENTION

1. Field of the Invention

The invention refers to an inertia projectile of sub-caliber comprising a penetrator and a caliber-compensating, at least partially hollow propellent cage.

2. Description of the Related Art

Inertia projectils are, as a rule, fired from gun barrels as shell ammunition. In this case, the speed as well as the mass of the inertia projecitle shall be a maximum. For this purpose there are used, as a rule, heavy-metal penetrators having a length as great as possible, a small diameter and a high mass. For giving sch a projectile of sub-caliber a high initial speed and for guiding the projectile within the gun barrel, supporting constructions, in particular propellent cages, are used for supporting and transmitting the gunpowder pressure. For ballistic reasons, total weight of the projectile is more or less optimized with reference to a defined amount and type of gunpowder. For making the penetrator mass as great as possible, there are therefore used propellent cages having a weight as low as possible and consisting of a high-strength aluminum alloy. The construction of the propellent cage shall reliably guide the projectile within the barrel and transform completely the disposable pressure into an acceleration of the penetrator. Furthermore, the propellent cage shall become detached from the penetrator after having left the barrel. This is, as a rule, effected by subdividing the propellent cage in a circumferential direction and by keeping together the individual parts for the transport in a manner, for example by means of a holding strip, making sure that the cage is detached from the projectile after having left the barrel.

SUMMARY OF THE INVENTION

The invention now aims at increasing the mass of the penetrator to a maximum with consideration of the predetermined total mass of the projectile. An increased mass of the penetrator results in a greater piercing efficiency. For performing this task, the invention essentially consists in that the propellent cage has at least one cavity extending over the axial length of the cage, is of closed design at its front surface and comprises within the rear portion at least one perforation being in open connection with the cavity. On account of the perforation within the rear portion of the propellent cage, part of the gas pressure arrives at the forward guiding part of the cartridge-case bases, so that the projectile is pushed as well as partially pulled. In case of a corresponding adjustment of the perforations, even a tension-free zone can be obtained within the length of the cartridge-case base. On account of this favorable distribution of the stresses, the wall thickness of the propellent cage can be reduced and the weight thus saved can be added as mass to the penetrator or arrow, respectively.

For making sure that the front surface tightly engages the barrel when being subjected to pressure from the interior of the cavity and that the front surface fulfills its task to guide the projectile, the front surface is, advantageously, conically designed and has its generatrices converging in direction to the tip of the penetrator.

For increasing the strength in spite of a low wall thickness and for making sure the generation of a sufficient pressure behind the rear portion, the rear portion is advantageously comprising at least one annular groove, in the bottom of which the perforations are arranged. With a corresponding depth of this groove it is possible to improve tight engagement of the rear portion, for which purpose the annular groove of the rear portion has a depth corresponding at least to half of the remaining wall thickness, preferably approximately to the remaining wall thickness of the rear portion.

For symmetrically subjecting the interior cavity of the propellent cage to pressure in a reliable manner, it is possible to provide, advantageously, at least two, preferably at least three, bores within the rear portion with equal distance in circumference. To provide for a rapid propagation of the pressure wave within the interior of the propellent cage, the cavity is advantageously designed to extend over the whole circumference. For improving tightness, the cavity can be closed in an outward direction by a cylindrical mantle surface, in particular of synthetic plastic material.

A further improvement of the tightness of the propellent cage and of a tight guiding within the barrel can be obtained if the front surface and/or the rear portion has at its outer circumference annular sealings and tightly engages the mantle at least at the front surface. The sealing at the front surface is required in particular for preventing lateral escape of the gas pressure acting against the front surface.

The perforations of the rear portion can advantageously be dimensioned such that approximately 50 percent of the pressure built up behind the propellent cage are at disposal at the front wall as a pulling force, which results in a reliable pressing action on the inner side, facing the penetrator, of the propellent cage and in an improved frictional connection of the propellent cage relative to the penetrator within the interior of the barrel.

BRIEF DESCRIPTOIN OF THE DRAWINGS

The sole FIGURE shows a cross-sectional view through the upper half of the projectile of the present invention.

DETAILED DESCRIPTION OF THE PREFERRED EMBODIMENT

Surrounding penetrator 1, a propellent cage is is provided in its rear portion with bores 3 opening into the interior of a continuous cavity 4. For maintaining a pressure within the cavity 4, there is provided an annular sealing lip 5 to which is joined a sealing cylinder 6. The sealing lip designed as an annular sealing 5 as well as the sealing cylinder 6 are formed of polyethylene. The front wall 7 of the propellent cage 2 is of conical design converges in a direction towards the penetrator 1. A pressure built up within the cavity 4 thus acts in the sense of expanding this front wall 7 and in the sense of improving pressing action on the sealing 5 in a perpendicular direction to the barrel 8.

The bores 3 are provided on the bottom of a groove 10 provided within the rear portion 9, the groove 10 having a depth a essentially corresponding to the wall thickness b of the rear portion 9. The pressure built up behind the rear portion 9 equally acts, on account of this groove 10, in the sense of pressing the outer contour of the rear portion against the barrel 8.

On account of the pressure built up within the cavity 4 one can do without any frictional connection of the propellent cage 2 with the penetrator 1 over the whole axial length of the propellent cage 2 and a double support is sufficient as is indicated by the step 11 located at the rear area of the penetrator 1 and by the annular groove 12 in the forward end portion of the penetrator 1. In the intermediate area, the internal wall of the propellent cage 2 is pressed against the penetrator 1 on account of the gas pressure built up within the cavity 4, thus making sure the frictional connection occurs. The penetrator 1 can thus be substantially smooth at its outer side so that the ballistic properties can be improved.

Based on equal total weight of the penetrator 1 and the propellent cage 2, as compared with known constructions, the mass of the penetrator 1 of the construction shown in the drawing can relatively be increased, because the propellent cage 2 has an only low weight. The sealing cylinder 6 can also fulfill the function of a holding ring, which becomes deformed and detached after leaving the barrel 8, so that the propellent cage parts can detach themselves from the penetator 1.

What is claimed is:

1. An inertia projectile of sub-caliber comprising:

a penetrator having a longitudinal axis and a front tip;

a caliber-compensating propellent cage surrounding the penetrator, said cage having a conical front wall sloping forwardly toward the front lip of the penetrator, said cage also having a rear wall with a depressed annular groove therein;

a cylindrical side wall means, extending from the front wall to the rear wall and being spaced from the penetrator, for sealing a cavity between the front wall and the rear wall, said cavity being completely and tightly closed at the front wall; and communication means, provided by a plurality of relatively small perforations spaced apart from each other in the depressed annular groove of the rear wall, for connecting openly with the cavity.

2. An inertia projectile as in claim 1 characterized in that there are at least two perforations equidistantly distributed in a circular pattern about the longitudinal axis of the penetrator.

3. An inertia projectile as in claim 1, characterized in that the cavity is a continuous annular cavity surrounding the penetrator.

4. An inertia projectile as in claim 1 characterized in that at least one of the front wall and the rear wall has at leat one annular seal means, provided at its outer circumference, for engaging a barrel.

5. An inertia projectile as in claim 1, characterized in that said annular groove has a depth corresponding to at least half of the thickness of said rear wall.

6. An inertia projectile as in claim 5, characterized in that said perforations are dimensioned such that approximately 50 percent of the pressure built up behind the propellent cage acts as a tension force at said front wall.

7. An inertia projectile as in claim 2 wherein there are at least three perforations.

8. An inertia projectile as in claim 1 wherein said cylindrical side wall is made of synthetic plastic material.

9. An inertia projectile as in claim 4 wherein said annular seal means is located at said front wall and also forms a seal between said front wall and said cylindricla side wall means.

* * * * *